United States Patent [19]

Boyars et al.

[11] 4,432,285

[45] Feb. 21, 1984

[54] BOMB BLAST ATTENUATOR

[75] Inventors: Carl Boyars, Silver Spring; David J. Edwards, Columbia, both of Md.

[73] Assignee: The United States of America as represented by the Secretary of the Air Force, Washington, D.C.

[21] Appl. No.: 417,725

[22] Filed: Sep. 13, 1982

[51] Int. Cl.[3] ..... F42D 5/04

[52] U.S. Cl. ..... 109/49.5; 109/1 R; 89/36 R; 220/468; 220/453; 220/444; 150/52 H; 206/3

[58] Field of Search ..... 109/1 R, 49.5, 82, 84; 220/902, 468, 453, 88 R; 89/1 R, 1 M, 36 R, 36 A, 36 D; 86/1 B; 150/52 H; 206/3

[56] References Cited

U.S. PATENT DOCUMENTS

| | | | |
|---|---|---|---|
| 3,127,855 | 4/1964 | Conlon | 109/49.5 |
| 3,721,201 | 3/1973 | Boller | 109/49.5 |
| 3,739,731 | 6/1973 | Tabor | 109/49.5 |
| 3,786,956 | 1/1974 | Tabor | 220/63 R |
| 4,027,601 | 6/1977 | Hickerson | 109/1 R |
| 4,048,365 | 9/1977 | Hoover | 89/36 R |

*Primary Examiner*—Gene Mancene
*Assistant Examiner*—Kris R. Schulze
*Attorney, Agent, or Firm*—Donald J. Singer; Bobby D. Scearce

[57] ABSTRACT

A multipurpose container for the exigent storage of an explosive device found aboard an aircraft is provided which comprises a bucket-shaped member having a laminated wall structure of at least three metal layers and two foamed plastic layers between the confronting surfaces of the metal layers, and a detachable lid for said member defining a wall portion for said container of foamed plastic only, the laminations providing effective shock wave attenuation and directing a shock wave preferentially in the direction of the lid.

2 Claims, 7 Drawing Figures

BOMB BLAST ATTENUATOR

RIGHTS OF THE GOVERNMENT

The invention described herein may be manufactured and used by or for the Government of the United States for all governmental purposes without the payment of any royalty.

BACKGROUND OF THE INVENTION

This invention relates generally to containers for exigent storage of an explosive device, and more particularly to a multipurpose container for use in containing such devices found aboard an aircraft, said container configured to attenuate an explosive shock wave in a predetermined direction.

When an explosive device, such as a homemade bomb, is found aboard an aircraft in flight, a method currently proposed for handling the device in order to minimize the potential risk associated with its detonation is to place the device against an outer fuselage wall in a least-risk position, to cover the device with numerous blankets, and to soak the blankets with water. This treatment is designed to attenuate the explosive shock wave inwardly and to direct the major explosive force outwardly. This procedure suffers certain unnecessary disadvantages in that no provision is made for immediate containment of the device for transport from its place of discovery to a position of least risk to provide some measure of attenuation of its explosive force in the event of detonation during this transport, and valuable time may be wasted in securing blankets from storage and in drawing water to cover the device. Further, existing containers configured to provide a measure of attenuation of the explosive force of the device in the event of detonation are unacceptably bulky or of such configuration as to not be immediately available within an aircraft passenger compartment for the intended purpose.

The present invention provides a novel multipurpose container which may serve a principal function as a bomb blast attenuator, and in the intended use substantially reduces in critical importance the problems associated with the aforementioned conventional handling procedures. The container of this invention comprises a twopart structure, at least one part of which has a hollow bucket shape for receiving the explosive device, the other part comprising a lid or other covering member, the two parts being joinable by means such as overcenter clamps, threads or the like, to form an enclosure for the device. The first bucket-shaped part of the container has a laminated wall structure of stainless steel and foamed plastic configured to provide attenuation to an explosive shock wave, the second part of the container configured to exhibit minimal attenuation characteristics. Placement of the assembled container of the present invention in the least-risk position within the aircraft may preferably entail placement of the second, or least-attenuating, part immediately adjacent the fuselage wall in a least-critical location within the aircraft. The invention herein may be conveniently sized and configured to serve alternatively within the aircraft as a waste receptable, ice bucket or other container finding substantial use within the aircraft and which is ordinarily readily available for immediate emergency use.

It is, therefore, a principal object of the present invention to provide an improved explosive shock wave attenuating container for enclosing an explosive device.

It is a further object of the present invention to provide a multipurpose container for enclosing an explosive device aboard an aircraft.

It is yet a further object of the present invention to provide an explosive device container exhibiting predetermined directional shock wave attenuating characteristics.

These and other objects of the present invention will become apparent as the detailed description of certain representative embodiments thereof proceeds.

SUMMARY OF THE INVENTION

In accordance with the foregoing principles and objects of the present invention, a multipurpose container for the exigent storage of an explosive device found aboard an aircraft is provided which comprises a bucket-shaped member having a laminated wall structure of at least three metal layers and two foamed plastic layers between the confronting surfaces of the metal layers, and a detachable lid for said member defining a wall portion for said container of foamed plastic only, the laminations providing effective shock wave attenuation and directing a shock wave preferentially in the direction of the lid.

DESCRIPTION OF THE DRAWINGS

The present invention will be more clearly understood from the following detailed description of specific representative embodiments thereof read in conjunction with the accompanying drawings wherein:

FIGS. 2*a* and 2*b* illustrate the structure of a representative lid for the container of FIG. 1*a.

DETAILED DESCRIPTION

Figure 1A:
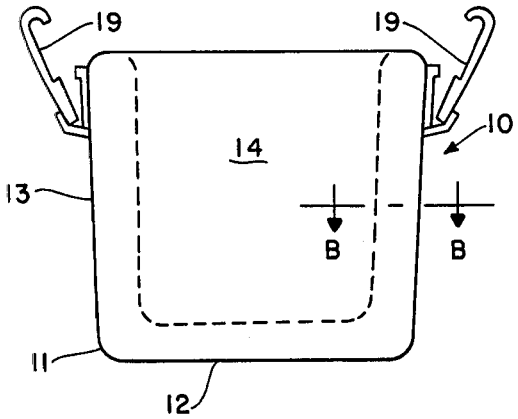
FIG. 1*a* is a side elevational view of a container of this invention.

Referring now to the drawings, FIG. 1*a* presents a side elevational view of a representative container 10 incorporating the invention herein. The container 10 includes a substantially cylindrically-shaped body portion 11 closed at one end with a bottom portion 12 and a generally cylindrically-shaped upstanding wall 13 defining a cavity 14. A container 10 constructed according to the teachings hereof may assume a variety of overall sizes and shapes, as would, for example, be appropriate for an ice bucket, trash receptacle, or other container customarily used and easily accessible within the passenger cabin of an aircraft.

Figure 1B:
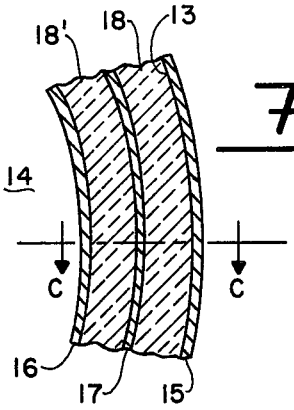
FIGS. 1*b* and 1*c* are sectional views of the wall structure of the container of FIG. 1*a;*
Figure 1C:
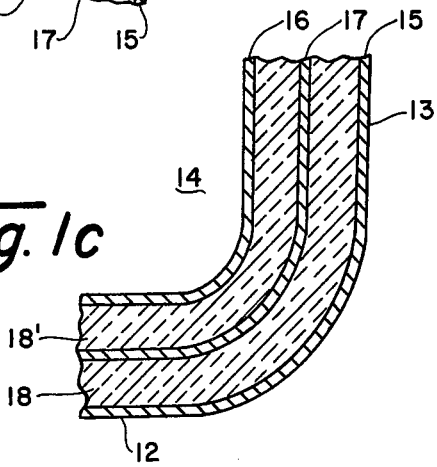

Referring additionally to FIGS. 1*b* and 1*c,* shown therein are, respectively, an enlarged fragmentary horizontal sectional view of wall 13 taken along lines B—B of FIG. 1*a,* and a vertical, fragmentary sectional view of wall 13 and bottom portion 12 of container 10 taken along lines C—C of FIG. 1*b.* Wall 13 and bottom 12 of container 10 comprise an outer stainless steel cladding layer 15, an inner stainless steel liner 16, one or more intermediate layers 17 of stainless steel, and a plurality of layers 18, 18' of styrofoam (or similar foamed plastic) between confronting surfaces of the stainless steel layers, to form the laminated structure substantially as shown in FIGS. 1*b* and 1*c*. The plurality of foamed plastic layers 18, 18', etc., serve as shock wave attenuating layers in cooperation with the stainless steel layers as discussed below.

In the fabrication of a container 10 of the present invention, the stainless steel layers, cladding 15, liner 16, and intermediate layers 17, may comprise nestable bucket-shaped members separated by foamed layers 18, 18', which either comprise preformed bucket-shaped plastic members configured to separate the steel layers or may comprise plastic layers foamed in place between assembled steel layers 15, 16, and 17.

Figure 2A:
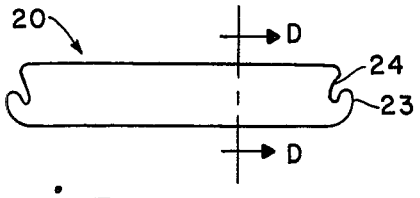
Figure 2B:
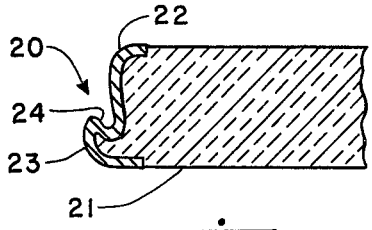

One configuration for a closure element or lid 20 for container 10 may be that as shown in FIGS. 2*a* and 2*b*, and comprises a flat member 21 of foamed plastic having substantially the same peripheral shape as that presented by the opening to container 10 of FIG. 1*a*. Lid 20 includes an annular metal frame 22 for providing peripheral structural integrity to lid 20 and for providing means to effect closure in combination with container 10 of FIG. 1*a*. For the configuration presented in FIGS. 1*a*, 2*a*, and 2*b*, a suitable closure means includes a plurality of latches 19 on wall 13 of container 10 substantially as shown. Annular frame 22 includes a lip 23 defining annular groove 24 configured to receive latch 19 for securing lid 20 to container 10. Latches 19 are only representative of the locking means for closing container 10, as other means including clamps, mating threads on lid 20 and container 10, and the like, are fully contemplated hereunder.

Lid 20 is configured to provide an unclad wall portion (member 21 of FIG. 2*b*) for the closed container of the present invention which is characterized by negligible shock wave attenuation as compared to the remainder of the assembly (i.e., the laminated structure 12, 13 of container 10). Therefore, when the two parts, lid 20 and container 10, are clamped together to form a closure enveloping an explosive device, a least-risk position for the closure near an aircraft wall comprises placement of the unclad, minimally attenuating wall portion (i.e., member 21) immediately adjacent the aircraft wall. The laminated wall structure 12, 13 of container 10 attenuate any shock wave from the exploding device significantly more effectively in the direction of the cabin compartment of the aircraft, and, concomitantly, will direct the shock wave preferentially outwardly toward the aircraft wall.

Figure 3A:
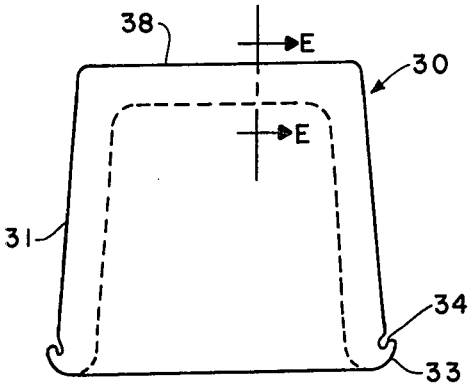
* and FIGS. 3*a* and 3*b* show a representative covering member and its constituent wall structure for the container of FIG. 1*a* as an alternate to the lid depicted in FIGS. 2*a* and 2*b.*
Figure 3B:
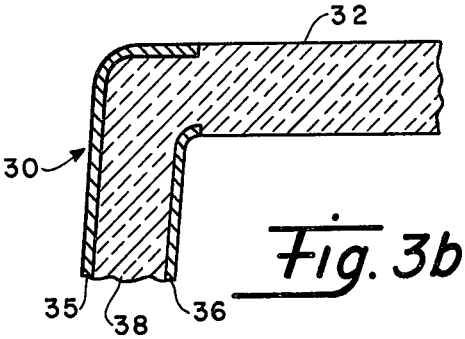

As shown in FIGS. 3*a* and 3*b*, a covering member which may be used in cooperation with container 10 to provide effective closure for an explosive device, may conveniently take the form of a mating closure member 30 of size, shape and utility generally similar to that of container 10 of FIG. 1*a*.

Closure member 30 may therefore comprise a generally cylindrically-shaped body portion 31 and bottom portion 32. Body 31 includes an inner liner 36 and cladding 35, each of material similar to equivalent parts of container 10 of FIG. 1*a*. Separating cladding 35 and liner 36 is a layer 38 of styrofoam or other foamed plastic. Only body 31 comprises a metal liner and cladding; bottom portion 32 remains unclad and unlined so that it may present a wall portion of the container 10-closure member 30 assembly which exhibits minimum attenuation substantially as that exhibited by member 21 of lid 20 (see FIG. 2*b*). Body 31 of member 30 may include closure means in cooperation with container 10 as represented by lip 33 defining annular groove 34 for receiving latches 19.

Shock impedance calculations were performed for a model container of the present invention configured substantially as shown in FIGS. 1*a–c*. The container 10 comprised a wall lamination of three 0.10-inch thick layers of stainless steel (density 7.896 gm/cc) separated by two layers of 0.50-inch thick styrofoam (density 0.174 gm/cc). The explosive considered was cast 50/50 pentolite (density 1.65 gm/cc) having a detonation pressure of about 260 kbar. The explosive device is assumed placed closely adjacent the aircraft wall and the detonation shock wave traveling substantially perpendicular to the laminations of the container wall. Based on these data and assumptions, the Hugoniot equation defining the shock wave behavior indicates that the initial shock pressure on the outside of the container is $\simeq 1$ kbar, and the initial material velocity is $\simeq 0.01$ mm/$\mu$sec. If the device were detonated in the open, the peak pressure would be about the same, but the material velocity would be about two orders of magnitude faster.

The container described herein therefore provides the means to expeditiously enclose an explosive device to reduce the potential damage to the aircraft in the event of detonation. The laminated wall structure is characterized by shock impedance mismatch at the metal-plastic interfaces sufficient to provide an attenuation factor of about 10 compared to the unclad portions of the covering elements. Additional laminations in the wall structure would provide additional attenuation, but with diminishing added effectiveness. The container may exhibit added effectiveness when used in conjunction with other techniques for reducing the effect of a detonation, viz., means, such as straps or clamps, for firmly securing the container to a wall in the least-risk position, and surrounding the container with water-soaked blankets.

The present invention, as hereinabove described, therefore provides an improved bomb blast attenuator characterized by its simplicity of construction and utility aboard an aircraft for alternative containment purposes. It is understood that certain modifications to the invention as described may be made as might occur to one with skill in the field of this invention, within the scope of the appended claims. Therefore, all embodiments contemplated hereunder have not been shown in complete detail. Other embodiments may be developed without departing from the spirit of this invention or from the scope of the appended claims.

We claim:

1. A multipurpose container, for the exigent storage of an explosive device aboard an aircraft, comprising:

a. a substantially cylindrically-shaped receptacle for receiving said device, said receptacle having one open end and a laminated side and bottom wall structure of a plurality of nested one-piece layers of foamed plastic and alternate nested one-piece metallic layers and including a said metallic layer as an outer cladding layer and a said metallic layer as an inner liner layer, said laminated structure preferentially directing an explosive shock wave from said device in the direction of said open end by providing attenuation of said shock wave by shock wave impedance mismatch at the interfaces of said plastic and metallic layers;

b. a foamed plastic lid member for said open end of said receptacle, said lid member providing negligible attenuation of said explosive shock wave, and toward which said shock wave is preferentially directed by said laminated wall structure; and c. latching means on said receptacle and the peripheral edge of said lid for securing said lid to said receptacle.

2. The container as recited in claim 1 wherein said metallic layers comprise steel and said foamed layers comprise styrofoam.

* * * * *